United States Patent [19]

Rozema et al.

[11] 3,982,220

[45] Sept. 21, 1976

[54] VARIABLE RESISTANCE CONTROL

[75] Inventors: Arthur L. Rozema; John D. Van Benthuysen, both of Elkhart, Ind.; John Zdanys, Edwardsburg, Mich.

[73] Assignee: CTS Corporation, Elkhart, Ind.

[22] Filed: Sept. 23, 1974

[21] Appl. No.: 508,349

Related U.S. Application Data

[63] Continuation of Ser. No. 447,968, March 4, 1974, abandoned.

[52] U.S. Cl. ..... 338/174; 338/162; 338/184; 338/202; 338/DIG. 1

[51] Int. Cl.[2] ..... H01c 10/34; H01C 1/12

[58] Field of Search ..... 338/118, 174, 175, 184, 338/202, 180, 183, 199, 197, 162, 164, 166, 167, 168, 169, 170, 171, 172, 173

[56] References Cited

UNITED STATES PATENTS

| | | | |
|---|---|---|---|
| 2,958,839 | 11/1960 | Barden | 338/174 |
| 3,242,452 | 3/1966 | Grunwald et al. | 338/174 |
| 3,375,478 | 3/1968 | Van Benthuysen et al. | 338/174 |
| 3,378,804 | 4/1968 | Cartwright | 338/174 |
| 3,416,119 | 12/1968 | Van Benthuysen et al. | 338/174 |
| 3,670,286 | 6/1972 | Bang et al. | 338/180 |
| 3,743,999 | 7/1973 | Miyashita | 338/118 |

*Primary Examiner*—A. Bartis

[57] ABSTRACT

A variable resistance control containing a one-piece stamped mounting bracket having an integral collector ring for positioning a rotatable gear and having a pair of integral yokes for aligning a lead screw in driving relationship with the rotatable gear. A contactor constrained to rotate with the gear wipingly engages a resistance element. Each of the yokes comprises a pair of arms arcuately clinched around the lead screw to secure the lead screw to the mounting bracket. Integral with the gear are two outwardly extending resilient fingers for engagement with a respective one of the yokes to arrest rotation of the gear. Continued rotation of the lead screw after rotation of the gear has been arrested flexes the resilient finger toward the lead screw for driving the gear out of engagement with the lead screw. An aperture is provided in the lead screw for insertion of a shaft or tool for remote actuation of the control or for actuation of another control.

12 Claims, 6 Drawing Figures

VARIABLE RESISTANCE CONTROL

This is a continuation of application Ser. No. 447,968 filed on Mar. 4, 1974, now abandoned.

The present invention relates to variable resistance controls, and more particularly, to variable resistance controls suitable for fine tuning or adjustment.

Many variable resistance controls are used in varactor diode tuning applications, such as the control disclosed in U.S. Pat. No. 3,375,478 assigned to the same assignee as the present invention. Often it is necessary that these controls be capable of being fine tuned or adjusted. Typically, a worm gear arrangement consisting of a gear and a lead screw enclosed in a housing is used for fine tuning a variable resistance control. However, the addition of a housing in the above mentioned control to support and secure a worm gear arrangement results in a relatively complex control. It would therefore be desirable to provide a fine adjust means in controls of the type disclosed in the above mentioned patent that minimizes the number of additional component parts required and maximizes the use of existing component parts and assembly techniques.

To obtain optimum engagement between the lead screw and the gear of a variable resistance control requires a relatively precise alignment of the lead screw and the gear within the control. In prior art controls wherein the lead screw and gear are contained within a molded housing, the alignment of the lead screw and gear is generally achieved by a molded lead screw support and a molded shaft aligning the gear with respect to the lead screw. However, the alignment of the lead screw with respect to the gear in a molded housing is often susceptible to environmental changes, and if the alignment is not optimum after the housing is molded, it is impractical to modify the housing in the production process to optimize the alignment. It would therefore be desirable to minimize the effects of the environment of the alignment and engagement of a lead screw and gear in a variable resistance control and to provide greater flexibility in the production process for readjusting the alignment of the lead screw and gear.

Variable resistance controls are often provided with a stop mechanism to limit or halt travel of a contactor beyond predetermined limits, normally near the ends of a resistance element. After the stop mechanism has halted the rotation of the contactor continued rotation of the lead screw could result in damage to the control, such as stripping of the teeth or threads from the engaged gear and lead screw. To avoid damage to the control, various types of clutches are currently available such as the clutch disclosed in the Van Benthuysen U.S. Pat. No. 3,416,119 wherein the slipping action between the driven member and the driving member is provided by a flexible rim on the periphery of the gear and wherein the rotation of the contactor is halted by additional components such as a stop arm extending from the bottom wall of the housing and a stop member integral with the driven member. Although this type of clutch works satisfactorily in an enclosed housing, there is a tendency of the gear to ride out of engagement with the lead screw when the gear is not restricted by a housing. It would therefore be desirable to provide a simplified clutching arrangement that does not require a housing and wherein the member that provides the slipping action between the driven member and the driving member also provides one of the stop members for halting rotation of the contactor.

It is often necessary in variable resistance control applications to be able to remotely actuate the control or be able to extend a tool through the control for actuation of another control. It would therefore be desirable to provide a lead screw in a variable resistance control that can be remotely actuated or that can receive a tool for actuation of another control.

Accordingly, it is an object of the present invention to provide a new and improved variable resistance control having the various desirable features set forth above.

An additional object of the present invention is to provide a new and improved variable resistance control with a collector element supporting a lead screw drivingly engaging a gear constraining a contactor to rotate therewith.

Another object of the present invention is to provide a new and improved variable resistance control comprising a lead screw and a mounting bracket having an integral collector and a pair of integral yokes, each of the yokes comprising a pair of arms clinched over the lead screw to secure the lead screw to the mounting bracket.

Another object of the present invention is to provide a one-piece metal stamped mounting bracket in a variable resistance control provided with an aperture for positioning a rotatable gear and provided with a pair of yokes to align a lead screw with respect to the rotatable gear.

Still another object of the present invention is to provide a variable resistance control with a new and improved clutching arrangement.

Still another object of the present invention is to provide a new and improved variable resistance control having a mounting bracket for supporting a lead screw and a gear containing a resilient finger extending outwardly therefrom to abut the bracket for arresting the rotation of the gear whereby continued rotation of the lead screw flexes the resilient finger toward the lead screw driving the lead screw out of engagement with gear.

Another object of the present invention is to provide a new and improved variable resistance control having a lead screw engaging a gear, the lead screw containing an aperture adapted for receiving a tool for remote actuation of the control or for actuation of another control.

Further objects and advantages of the present invention will become apparent as the following description proceeds and the features of novelty characterizing the invention will be pointed out in particularity in the claims annexed to and forming a part of the specification.

Briefly, the present invention is concerned with a variable resistance control comprising a lead screw and a one-piece stamped mounting bracket having an integral collector ring provided with an aperture and a pair of integral yokes supporting the lead screw. A rotatable gear is journaled in the aperture of the collector ring and the lead screw is aligned by the yokes in driving relationship with the gear. A contactor is constrained to rotate with the gear for wipingly engaging a resistance element. Each of the yokes comprises a pair of arms arcuately clinched around the lead screw to secure the lead screw to the mounting bracket. Integral with the rotatable gear are two outwardly extending resilient fingers for engagement with a respective one of the yokes to arrest rotation of the gear. Upon engagement of one of the resilient fingers with one of the yokes, continued rotation of the lead screw flexes the resilient finger toward the lead screw for driving the gear out of engagement with the lead screw. An aperture is provided in the lead screw for insertion of a tool for remote actuation of the control or actuation of another control.

For a better understanding of the present invention, reference may be had to the accompanying drawings, wherein the same reference numerals have been applied to like parts and wherein.

Figure 1:
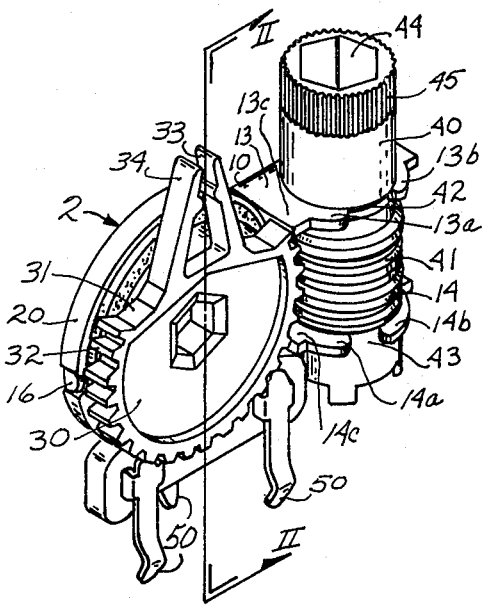
FIG. 1 is an isometric view of an improved variable resistance control built in accord with the present invention.

Referring now the the drawings, there is illustrated a variable resistance control generally indicated at 2, comprising a mounting bracket 10 with an integral collector ring 11, a resistance element 20, a contactor 21, a rotatable gear 30, a lead screw 40 and terminals 50 secured to the resistance element 20. The details of the contactor 21, the resistance element 20, the terminals 50, and the wiping engagement of the collector ring 11 and the resistance element 20 by the contactor 21 form no part of the present invention and therefore will not be further discussed herein. These details are described in U.S. Pat. No. 3,375,478 which details are incorporated herein.

Figure 2:
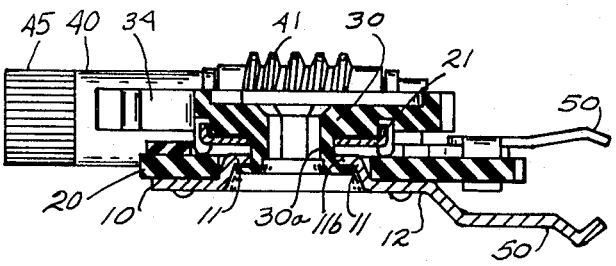
FIG. 2 is a sectional view of the variable resistance control taken along lines II—II of FIG. 1.
Figure 3:
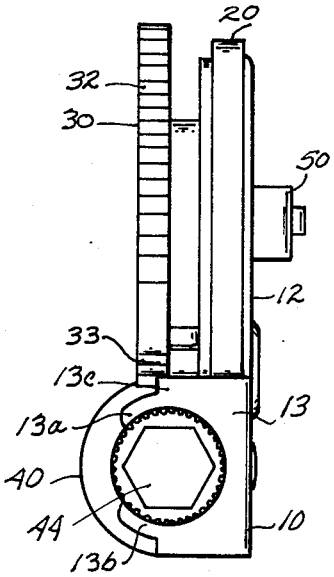
FIG. 3 is a side view of the control shown in FIG. 1.
Figure 4:
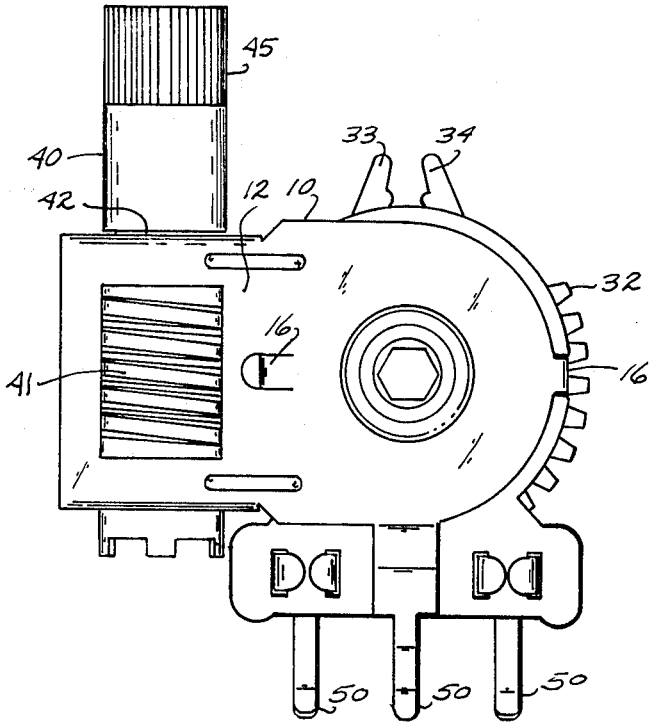
FIG. 4 is a bottom view of the control shown in FIG. 1.

The mounting bracket 10 preferably comprises a one-piece sheet metal stamping of brass or other suitable material having a flat base section 12 and a pair of yokes 13 and 14 extending perpendicular from the base section 12 and providing a mounting support for the lead screw 40. As seen in FIG. 2, the collector ring is embossed from the flat base section 12 and is provided with an aperture 11*b* for alignment of the rotatable gear 30. A shaft or spinlde 30*a* extends inwardly of the rotatable gear 30 and is journaled in the aperture 11*b*. It should be understood that the mounting bracket 10 can be provided with mounting tabs for quickly mounting and electrically connecting a portion of the variable resistance control 2 to a panel or the like. For preventing relative rotation between the resistance element 20 and the mounting bracket 10, a pair of inwardly extending ears 16 are disposed in suitable locations on the flat base section 12 and engage notches in the resistance element 20. The one-piece sheet metal stamping provides a common base for locating the aperture 11*b* with respect to the yokes 13 and 14 for positive alignment of the lead screw 40 with respect to the rotatable gear 30 and allows for the reforming of the bracket 10 in the production process to realign the yokes and the aperture. Each of the yokes 13 and 14 comprise a pair of arcuate arms 13*a*, 13*b* and 14*a*, 14*b* for securing the lead screw 40 to the mounting bracket 10 and abuttment members 13*c* and 14*c* for arresting rotation of the rotatable gear 30.

The lead screw 40 is nylon or other suitable material and is provided with a plurality of threads 41 for engaging the rotatable gear 30 and a pair of grooves 42 and 43 for receiving the arms 13*a*, 13*b* and 14*a*, 14*b* of the yokes 13 and 14 respectively. Preferably, a hexagonally shaped center aperture 44 is provided in the lead screw 40 for receiving a not shown tool or shaft for remote actuation of the lead screw 40 or for actuation of another control. The yokes 13 and 14 interfit with the grooves 42 and 43 respectively to align the lead screw 40 on the mounting bracket 10 and to prevent the axial displacement of the lead screw 40. The arms 13*a* and 13*b* are clinched into the groove 42 and the arms 14*a* and 14*b* are clinched into the groove 43 to secure the lead screw 40 to the mounting bracket 10. A knurled portion 45 is provided on one end of the lead screw 40 for attachment of a not shown knob.

Figure 5:
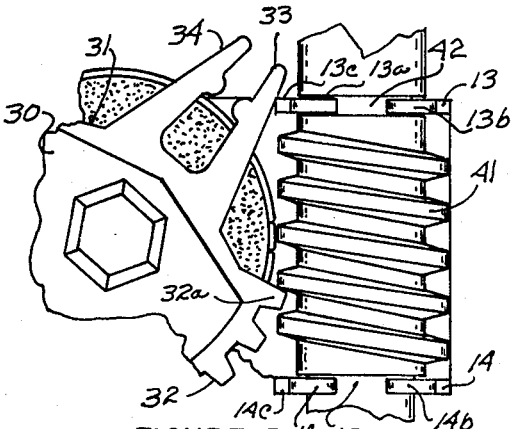
FIG. 5 is a top plan view of the lead screw and gear upon arresting the rotation of the gear.
Figure 6:
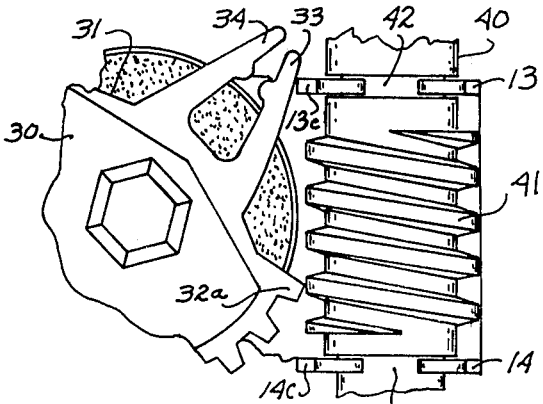
FIG. 6 is a top plan view of the lead screw and gear after rotation of the gear is arrested and rotation of the lead screw is continued.

In accord with the present invention, the rotatable gear 30 is provided with a truncated section 31 and with a plurality of gear teeth or cogs 32 around the periphery of the gear forming a gear section. In a device built in accord with the present invention, the rotatable gear 30 is molded of an electrically nonconductive heat deformable material such as nylon and the gear section formed by the gear teeth 32 preferably extends 260° around the periphery of the rotatable gear 30. The threads 41 of the lead screw 40 engage the gear teeth 32 to drive the rotatable gear and the gear and the lead screw are arranged to provide a 30 to 1 gear ratio. Extending outwardly from the truncated section 31 of the rotatable gear are a pair of resilient fingers 33 and 34 for engaging abuttment members 13*c* and 14*c* of yokes 13 and 14. The resilient finger 33 engages the abuttment member 13*c* to arrest the clockwise rotation of the rotatable gear 30 as seen in FIG. 5 and the resilient finger 34 engages the abuttment member 14c to arrest the counterclockwise rotation of the gear 30. 14*c* rotatable gear 30 and the lead screw 40 are so arranged that upon arresting of the rotation of the rotatable gear by the engagement of one of the resilient fingers 33 and 34 with one of the abuttment members 13*c* and 14*c*, the cog at one end of the gear portion of the rotatable gear 30 is interfit between two of the lead screw threads 41 at one end of the lead screw. With reference to FIG. 5, with the resilient finger 33 in engagement with abuttment member 13*c*, the end cog 32*a* of the rotatable gear is interfit between two threads at the end of the lead screw 40. Continued rotation of the rotatable gear in a clockwise direction causes the resilient finger 33 to flex toward the lead screw, allowing the end cog 32*a* to ride out of engagement with the lead screw threads as seen in FIG. 6. Thereafter, continued clockwise rotation of the lead screw with the resilient finger 33 in engagement with the abuttment member 13*c* causes the end cog 32*a* to ride over the top of one of the lead screw threads, the resilient finger springing the rotatable gear back into engagement with the threads of the lead screw as seen in FIG. 5. A similar clutching action occurs when the rotatable gear is rotated in a counterclockwise direction and the resilient finger 34 engages the abuttment member 14*c*.

The variable resistance control 2 can be rapidly assembled in production. Except for the attachment of the lead screw 40 to the yokes 13 and 14, once the rotatable gear 30 with resilient fingers 33 and 34 has been molded and the mounting bracket 10 with integral yokes 13 and 14 has been stamped and formed, the details of the assembly of the variable resistance control 2 are similar to the details of the assembly of the control described in above mentioned U.S. Pat. No.

3,375,478 which details are incorporated herein. Briefly, the rotatable gear 30 is assembled to the mounting bracket 10 by merely inserting the end of the shaft 30*a* into the aperture 11*b* of the collector ring and heat swaging the end of the shaft projecting outwardly from the collector ring. This secures the mounting bracket 10 to the rotatable gear 30 and the resistance element 20. To complete the assembly, the lead screw 40 is clinched by the arms 13*a*, 13*b* and 14*a*, 14*b* to the yokes 13 and 14.

While there has been illustrated and described what at present is considered to be a preferred embodiment of the present invention, it will be appreciated that numerous changes and modifications are likely to occur to those skilled in the art, and it is intended in the appended claims to cover all those changes and modifications which fall within the true spirit of the present invention.

What is claimed as new and desired to be secured by Letters Patent of the United States is:

1. A variable resistance control comprising a collector element, a resistance element disposed in spaced relationship with the collector element, a driven member supported by the collector element, a contactor carried by the driven member for wiping the collector element and the resistance element intermediate the ends thereof, a yoke integral with one of said collector element and said resistance element, and a driving member rotatably supported by the yoke and operably engaging the driven member, said yoke comprising at least one arm adapted for deformation for securing the driving member to the yoke.

2. The control of claim 1 including a bracket, the collector element and the yoke being integral with the bracket, said driven member being aligned by the bracket with the driving member, said at least one arm being clinched into engagement with the driving member.

3. The control of claim 2 wherein the driving member is a lead screw provided with a center aperture for receiving an actuating tool.

4. A variable resistance control comprising a stamped one-piece mounting bracket having a collector ring provided with an aperture and a plurality of yokes formed therefrom, a resistance element supported by the mounting bracket, a driven member overlying the collector ring and the resistance element, a contactor carried by the driven member for wiping the collector ring and the resistance element intermediate the ends thereof, an electrically nonconductive shaft of heat deformable material connected to the driven member and rotatably journaled in the aperture in the collector ring, and a driving member rotatably supported by the yokes and operably engaging the driven member, at least one of the yokes comprising an arm clinched about the driving member for securing the driving member to the yoke.

5. A variable resistance control comprising a collector, a resistance element disposed in spaced relationship with the collector, a driven member overlying the resistance element and the collector and rotatably supported thereby, a contactor carried by the driven member for wiping the collector and the resistance element intermediate the ends thereof, the contactor being constrained to rotate with the driven member, a yoke integral with one of said collector and said resistance element, a driving member rotatably supported by the yoke and operably engaging the driven member, and a finger integral with the driven member and extending outwardly therefrom for abutting the yoke and arresting rotation of the contactor, one of the finger and the yoke flexible whereby continued rotation of the driving member disengages the driven member from the driving member.

6. The control of claim 5 including a bracket, said yoke and collector being integral with the bracket, one of said bracket and said finger being resiliently flexible and being flexed upon engagement of the finger and the yoke and amount sufficient that continued rotation of the driving member disengages the driven member from the driving member.

7. The control of claim 6 wherein the finger is resiliently flexible and upon resilient engagement with the yoke flexes toward the driving member to disengage the driven member from the driving member upon continued rotation of the driving member.

8. In a variable resistance control, the combination of a mounting bracket, a collector integral with the mounting bracket, a resistance element secured to the bracket in spaced relationship with the collector, a driven member overlying the resistance element and the collector and rotatably supported thereby, a contactor carried by the driven member for wiping the collector and the resistance element intermediate the ends thereof, the contactor being constrained to rotate with the driven member, a yoke integral with the mounting bracket, a driving member rotatably supported by the yoke and operably engaging the driven member, and a resilient finger integral with the driven member and extending outwardly therefrom for flexibly abutting the mounting bracket to halt rotation of the contactor, the resilient finger being capable of being flexed upon engagement with the bracket an amount sufficient that continued rotation of the driving member causes the driven member to disengage from the driving member whereby upon continued rotation of the driving member the resilient finger flexes toward the driving member and disengages the driven member from the driving member.

9. A variable resistance control comprising a support member, a resistance element connected to the support member, a collector disposed in spaced relationship with the resistance element and carried by one of said support member and resistance element, a driven member rotatably supported by the support member, a contactor carried by the driven member and electrically engaging the collector element and the resistance element intermediate the ends thereof, the contactor being constrained to rotate with the driven member, a yoke carried by the supporting member, and a driving member rotatably supported by the yoke and operably engaging the driven member, said yoke being deformed at least paritally around the driving member and rotatably securing the driving member to the support member.

10. A variable resistance control comprising a bracket, a resistance element connected to the bracket, a collector disposed in spaced relationship with the resistance element and carried by one of said bracket and resistance element, a driven member rotatably supported by the bracket, a contactor carried by the driven member and electrically engaging the collector element and the resistance element intermediate the ends thereof, the contactor being constrained to rotate with the driven member, a yoke carried by the bracket, and a driving member rotatably supported by the yoke and rotatably engaging the driven member, said yoke rotatably supporting the driving member, said driven member comprising a shaft and a driven portion, the shaft being rotatably supported by the bracket and the driven portion being disposed adjacent to said bracket, the driving member engaging the periphery of the driven portion.

11. The variable resistance control of claim 10, wherein said collector is carried by the bracket and wherein said yoke comprises an arm deformed into engagement with said driving member for rotatably securing the driving member to the bracket.

12. The variable resistance control of claim 10, wherein the yoke comprises a pair of arcuate arms at least partially encircling the driving member and securing the driving member to the bracket.

* * * * *